United States Patent [19]

Rhodes

[11] Patent Number: 4,731,037

[45] Date of Patent: Mar. 15, 1988

[54] WATER SURVIVAL KIT

[76] Inventor: Mark A. Rhodes, 14361 Joyce Ave., Westminster, Calif. 92683

[21] Appl. No.: 9,482

[22] Filed: Feb. 2, 1987

[51] Int. Cl.[4] ..... B63B 35/38

[52] U.S. Cl. ..... 441/41; 441/42; 441/93

[58] Field of Search ..... 441/41, 42, 92–95, 441/101

[56] References Cited

U.S. PATENT DOCUMENTS 1,230,290 6/1917 Geiger ..... 441/93

3,046,575 7/1962 Davis et al. ..... 441/93

3,266,668 8/1966 Davis ..... 441/94

3,744,816 7/1973 Yamaguchi ..... 441/101 X

*Primary Examiner*—Sherman D. Basinger

*Attorney, Agent, or Firm*—Leon Gilden

[57] ABSTRACT

A portable water survival kit includes a small life raft apparatus which may be attached to and carried by a user. When needed, the small life raft may be quickly removed from a carrying case and inflated through the use of a permanently attached compressed gas cartridge.

6 Claims, 3 Drawing Figures

WATER SURVIVAL KIT

BACKGROUND OF THE INVENTION

1. Field of the Invention

The present invention relates to inflatable life rafts, and more particularly pertains to a new and improved life raft construction of a portable design which may be directly attached to the body of a user until needed.

2. Description of the Prior Art

There are numerous types of automatically inflatable life rafts presently in commercial use. Typically, these prior art inflatable life rafts are packed in an easily accessible manner within a storage container. At the time of deployment, a containerized raft may be tossed in the water where it will float, and a lanyard extending from the raft may be pulled to activate a carbon dioxide cylinder valve to inflate the raft. The inflation of the raft usually effects a separation of the container sections and renders the raft accessible to a user. A good prior art example of this type of containerized raft is to be found in U.S. Pat. No. 4,280,239, which issued to E. Brown on July 28, 1981. The Brown patent discloses a self righting, automatically inflatable life raft. Another prior art example of such a life raft is to be found in U.S. Pat. No. 2,095,974, which issued to H. Finch on Oct. 19, 1937. This patent also discloses a containerized raft which may be tossed in the water prior to inflation, with both of these rafts being activated by carbon dioxide cylinder valves.

While all of these prior art containerized life rafts are functional for their intended purposes, it can be appreciated that they are typically of a substantially large construction which prevents a direct attachment of their holding containers to an individual. Further, inasmuch as the rafts are not attachable to an individual, it will usually be necessary for such individual to swim to a raft to thus effect its inflation. In those situations where a person is not a good swimmer or perhaps suffers from an injury, it would be desirable to provide some means whereby the individual could be directly coupled to the life raft prior to a need for its use. In this respect, the present invention substantially fulfills this need.

SUMMARY OF THE INVENTION

In view of the foregoing disadvantages inherent in the known types of portable inflatable life rafts now present in the prior art, the present invention provides an improved portable inflatable life raft construction wherein the same can be compactly stored in a small container which is directly attachable to an individual's clothing or body. As such, the general purpose of the present invention, which will be described subsequently in greater detail, is to provide a new and improved portable inflatable life raft which has all the advantages of the prior art portable inflatable life rafts and none of the disadvantages.

To attain this, the present invention comprises a small foldable life raft which may be selectively inflated by a permanently attached carbon dioxide cylinder valve. The small raft may be retained within a small container which in turn is attachable to the clothing or body of a user. When needed, the raft may be quickly removed from the container, and a safety pin may then be manually pulled from the valve assembly. A manual actuation of the valve then effects the desired inflation of the raft. After a use, the raft may be deflated and folded for reinsertion into the carrying container. For purposes of reuse, a new carbon dioxide cylinder may be attached to the valve assembly.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable inflatable life raft which has all the advantages of the prior art portable inflatable life rafts and none of the disadvantages.

It is another object of the present invention to provide a new and improved portable inflatable life raft which may be easily and efficiently manufactured and marketed.

It is a further object of the present invention to provide a new and improved portable inflatable life raft which is of a durable and reliable construction.

An even further object of the present invention is to provide a new and improved portable inflatable life raft which is susceptible of a low cost of manufacture with regard to both materials and labor, and which accordingly is then susceptible of low prices of sale to the consuming public, thereby making such portable inflatable life rafts economically available to the buying public.

Still yet another object of the present invention is to provide a new and improved portable inflatable life raft which provides in the apparatuses and methods of the prior art some of the advantages thereof, while simultaneously overcoming some of the disadvantages normally associated therewith.

Still another object of the present invention is to provide a new and improved portable inflatable life raft which may be directly attached to the body of a potential user.

Yet another object of the present invention is to provide a new and improved portable inflatable life raft which is directly accessible by a user when needed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
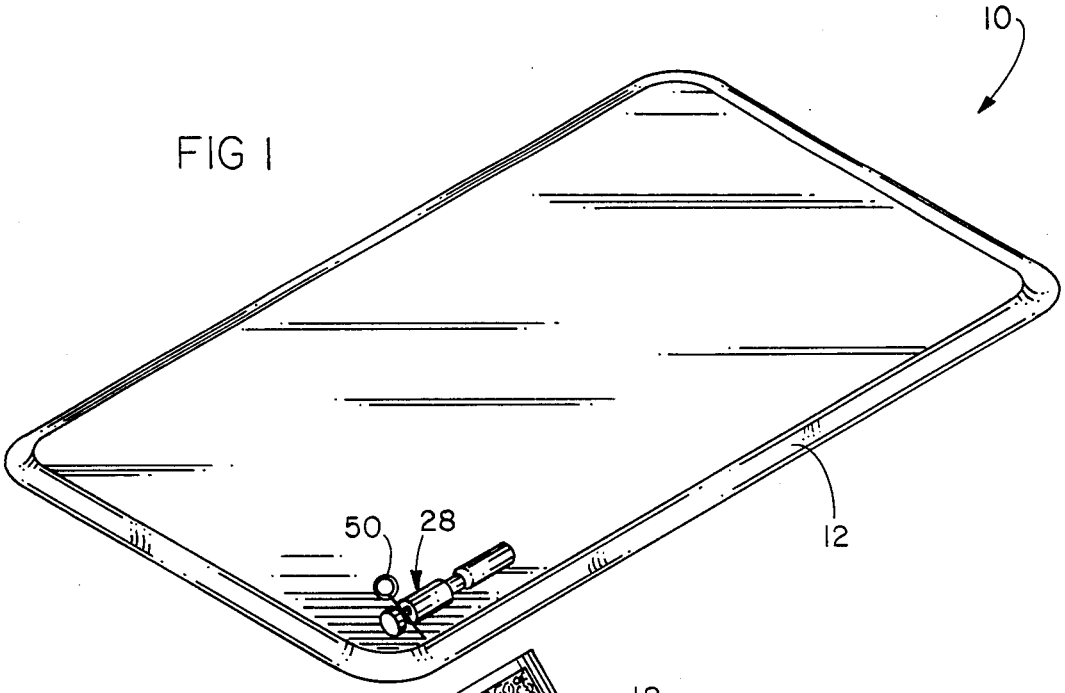
FIG. 1 is a perspective view of the portable inflatable life raft comprising a part of the present invention.
Figure 2:
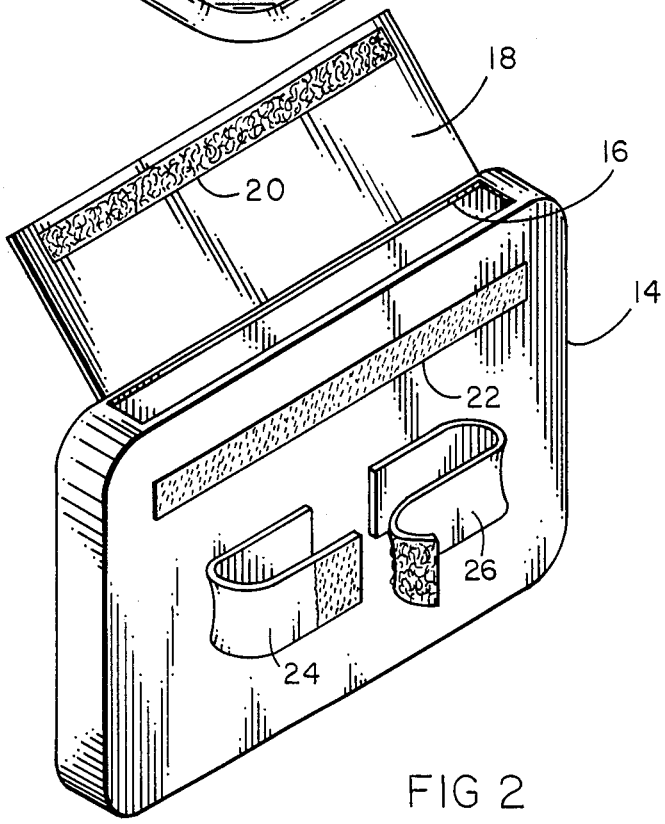
FIG. 2 is a perspective view of the carrying container for the life raft.

With reference now to the drawings, and in particular to FIGS. 1 and 2 thereof, a new and improved portable inflatable life raft embodying the principles and concepts of the present invention and generally designated by the reference numeral 10 will be described.

More specifically, it will be noted that the portable inflatable life raft construction 10 includes a substantially rectangularly shaped inflatable life raft 12 and a carrying case 14 in which the life raft may be compactly stored. The carrying case 14 is also typically of a rectangular shape and is small enough to effect a direct attachment thereof to the body or clothing of the user. A top opening 16 formed in the case 14 permits access to the life raft 12, and a flexible lid 18 may be used to close the opening to effectively retain the life raft therein. Conventional strips of hook and loop fasteners 20, 22 are employed to hold the lid 18 in a closed position. Additionally, a pair of attachment straps 24, 26 may be used to secure the case 14 to the clothing or body of a user, and these straps also employ the use of hook and loop fasteners as clearly illustrated in FIG. 2.

Figure 3:
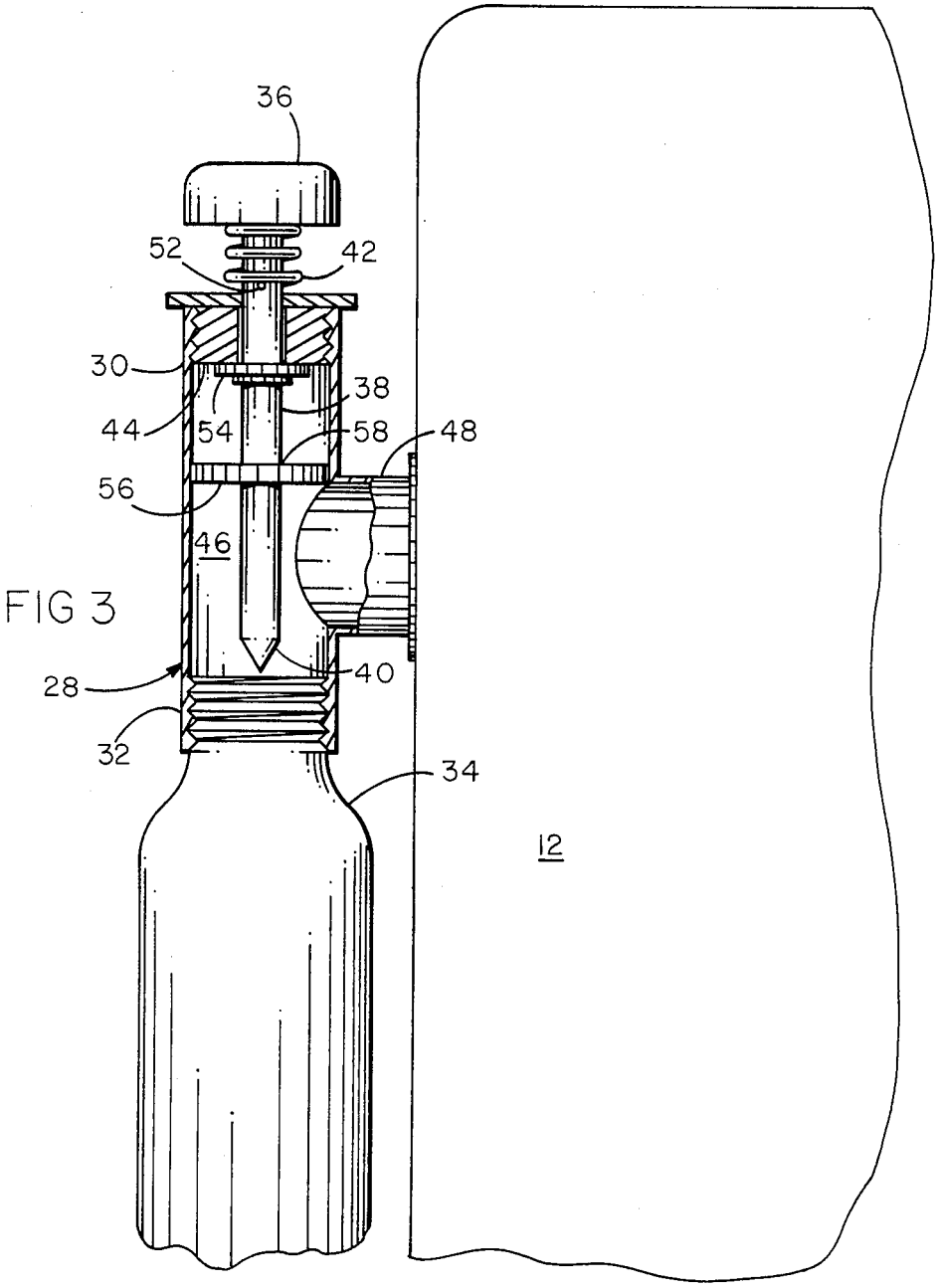
FIG. 3 is a side elevation detailed view, partly in cross section, illustrating the carbon dioxide valve assembly forming a part of the present invention.

The inflatable life raft 12 has a permanently attached inflation valve assembly 28 which may be manually actuated by a user to effect an inflation of the raft. With reference to FIG. 3 of the drawings in conjunction with FIG. 1, it will be observed that the valve assembly 28 is of a T-shaped construction which is partially defined by first and second ends 30, 32, respectively. The end 32 of the valve assembly 28 is designed to threadably receive a conventional compressed gas cartridge 34, such as a carbon dioxide cylinder, and the end 30 holds a manually reciprocable valve member 36. The valve member 36 includes an elongated shaft 38 having a pointed end 40 which is utilized to rupture the top of the compressed gas cartridge 34. A spring member 42 holds the pointed end 40 away from the compressed gas cartridge 34, and an appropriate seal 44 maintains a fluid tight construction between the valve member 36 and an interior portion 46 of the valve assembly 28.

A conduit branch 48 is in fluid communication with an interior portion of the life raft 12, and a safety pin 50 is insertable into an aperture 52 formed through the valve member 36. The safety pin 50 prevents the reciprocable movement of the valve member 36 until the pin is removed. A flange member 54 is fixedly secured to the shaft 38 and operates to prevent the valve member 36 from becoming totally disengaged from the valve assembly 28 due to its fixed securement to the shaft. A further guide member 56 is positioned in a cross-extending manner within the interior portion 46 of the valve assembly 28 and includes a through-extending aperture 58 through which the shaft 38 extends. The guide member 56 serves to retain the shaft 38 in direct axial alignment with the compressed gas cartridge 34, thus to insure the reliable operation of the valve assembly 28 when needed.

As to the manner of usage and operation of the present invention, the same should be apparent from the above description. However, a brief summary thereof will be provided. More particularly, it can be observed that the carrying case 14 may be directly attached to the body or clothing of a user by means of the attachment straps 24, 26. When needed, a user needs only to open the flap 18 and withdraw the deflated, folded life raft 12 therefrom. A quick removal of the safety pin 50 will then allow the user to manually depress the valve member 36. The depression of the valve member against the bias of the spring 42 will result in the pointed end 40 rupturing the compressed gas cartridge 34. Compressed gas will then be directed through the conduit 48 into the life raft 12 to thus effect an inflation thereof. After a desired use of the life raft 12, the same may be deflated by a removal of the gas cartridge 34, and a new gas cartridge may then be threadably attached to the valve assembly 28 to prepare the life raft for a future use.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved inflatable life raft assembly comprising:

inflatable life raft means;

valve assembly means directly attached to said inflatable life raft means by a conduit without any other intervening support structure positioned between said valve assembly means and said raft, said valve assembly means includes a manually reciprocable valve member means for effecting inflation of said life raft means; said manually reciprocable valve member means including a non-shearable pin means positioned for manual removal within an aperture contained within a shaft of said valve member for manual removal to permit reciprocation of said valve member, said shaft formed with a manually engageable first end extending outwardly and exteriorly of a housing first end and extending interiorly of said housing terminating in a pointed second end proximate a compressed gas means securable to said housing at a housing second end remote from said housing first end, said non-shearable pin means positioned exteriorly of said housing, and said compressed gas means operably attachable to said valve assembly means for releasing gas to said inflatable raft means upon reciprocation of said valve member to rupture said compressed gas means;

container means including a closure flap for enabling complete removal of said raft and valve member from said container means and for carrying said inflatable life raft means in a deflated condition, and attachment means for effecting a direct attachment to a user prior to an inflation of said inflatable life raft means.

2. The new and improved portable inflatable life raft as described in claim 1, wherein said attachment means comprises flexible straps having hook and loop attachment means.

3. The new and improved portable inflatable life raft as described in claim 1, and further including guide means positioned within said valve assembly means, said guide means serving to direct said reciprocable valve member into contact with said compressed gas means.

4. The new and improved portable inflatable life raft as described in claim 3, and further including flange means attached to said reciprocable valve member, said flange means preventing said valve member from becoming disengaged from said valve assembly means.

5. The new and improved portable inflatable life raft as described in claim 4, and further including seal means for preventing gas from escaping to the atmosphere after a rupture of said compressed gas means.

6. The new and improved portable inflatable life raft as described in claim 5, and further including spring biasing means for maintaining said reciprocable valve member out of rupturing contact with said compressed gas means.

* * * * *